US005141009A

United States Patent [19]

Morantz

[11] Patent Number: 5,141,009

[45] Date of Patent: Aug. 25, 1992

[54] ULTRASONIC GOLF CLUB CLEANING APPARATUS

[76] Inventor: Stan Morantz, 105 Snowflake Rd., Huntingdon Valley, Pa. 19115

[21] Appl. No.: 647,390

[22] Filed: Jan. 28, 1991

[51] Int. Cl.[5] ..... B08B 3/12

[52] U.S. Cl. ..... 134/57 R; 134/1; 134/58 R; 134/99.1; 134/104.1; 134/105; 134/113; 134/186

[58] Field of Search ..... 134/1, 57 R, 58 R, 95, 134/99, 104.1, 105, 108, 113, 184, 186; 15/21.1, 88.2, 88.3

[56] References Cited

U.S. PATENT DOCUMENTS 3,007,478 11/1961 Leonhardt et al. ..... 134/186 X
3,101,089 8/1963 Brown et al. ..... 134/1 X
3,619,841 11/1971 Russell et al. ..... 15/21.1
3,648,315 3/1972 Hash ..... 15/88.3 X
3,709,732 1/1973 Thomen ..... 134/184 X
4,193,818 3/1980 Young et al. ..... 134/184 X
4,316,750 2/1982 Gengler ..... 134/104.1 X
4,710,233 12/1987 Hohmann et al. ..... 134/184 X

*Primary Examiner*—Philip R. Coe

[57] ABSTRACT

An apparatus for cleaning golf club heads and grips, the apparatus comprising a first tank for receipt of the club grip portion, a second tank for receipt of the club head portion, an acoustic wave generator, a tank filling mechanism, a tank emptying mechanism, a tank cleaning component, and an operational control unit. The tank filling mechanism is coupled to the first tank for filling the tanks with a cleaning liquid in response to the operational control unit. The acoustic wave generator is arranged to selectively produce acoustic waves in the cleaning liquid to effect the cleaning of the golf club portion(s) located therein for a predetermined period of time as established by the operational control unit.

20 Claims, 2 Drawing Sheets

ULTRASONIC GOLF CLUB CLEANING APPARATUS

BACKGROUND OF THE INVENTION

This invention generally relates to a golf club cleaning machine and more particularly to an ultrasonic golf club cleaning apparatus for cleaning golf club heads and grips.

Golfers who play golf outdoors on living turf often foul their clubs with grass, mud and other debris, which accumulates on the indented and flat portions of the grips and club heads. The debris on the club grips prevents a golfer from optimizing his/her golf swing by interfering with the golfer's grip on the club, potentially causing the golfer to lose the desired grip thereon during the full swing of a golf club. In addition, debris on the club head may potentially interfere with the path of the golf ball when the club face impacts the golf ball on the downswing.

Furthermore, debris on the golf club result not only in the decreased performance of the golfer including sliperiness of the club shaft, but also in the useful life of the equipment itself. By placing soiled clubs into a golf bag, the golfer thereby causes the golf bag to become soiled and/or damaged, with the potential for transporting the debris into the player's golf cart, car and home. It would therefore be extremely advantageous to provide a device for cleaning golf clubs which does not require the golfer to manually clean the clubs using rags, brushes and cleaning solutions.

One golf club head cleaning device and method of cleaning is that disclosed in U.S. Pat. No. 3,101,089 issued to Brown et al. In that device, ultrasonic energy is used to clean at least one club head which is submersed within a cleaning solution held in a tank. That device contains two tanks, one for wooden club heads and the other for metal club heads, the second tank having a greater number of ultrasonic transducers for cleaning the more resilient metal club heads.

While the Brown device is apparently suitable for its intended purposes, the device relies on the manual filling and draining of the tanks with the clean and/or soiled cleaning solution and/or water, necessitating the presence of a person to properly monitor the maintenance thereof. In addition, since the cleaning solution apparently must be manually poured into the tanks from the top of the device, this necessitates the separate storage of the cleaning solution apart from the device potentially resulting in spills, injury to the person pouring the liquid and/or to those in the vicinity of the device. Further, since the tanks are drained by manually opening a drain located at the bottom of the tanks, the device may only be cleaned when a person is present to perform that function, in addition to having to fill the tanks with a liquid to drain any sediment from the tanks prior to their being refilled with fresh cleaning solution. It therefore appears that the Brown device can only be properly activated and maintained during the business hours of the location at which the machine is located and may not be in a "ready" state for use at all times.

Accordingly, a need exists for an automatic, self-contained golf club cleaning apparatus to be used in cleaning golf club heads and grips.

OBJECTS OF THE INVENTION

Accordingly, it is a general object of this invention to provide a golf club cleaning apparatus which overcomes the disadvantages of the prior art.

It is a further object of this invention to provide a golf club cleaning apparatus which utilizes ultrasonic energy to efficiently clean either club heads or club grips.

It is yet another object of this invention to provide a golf club cleaning apparatus which is automatically operated.

It is still another object of this invention to provide an golf club cleaning apparatus which is easily maintained with a minimum of effort.

It is yet still another object of this invention to provide a golf club cleaning apparatus which automatically fills, empties and refills the club cleaning tanks after a predetermined number of cleanings without requiring manual intervention.

It is another object of this invention to provide a golf club cleaning apparatus which automatically audibly signals to the user when the cleaning cycle is completed.

It is yet still a further object of this invention to provide a golf club cleaning apparatus which utilizes a controller to permit the monitoring of the device for signs of tampering and/or successful attempts to utilize the device without having inserted a token or coin therein prior to use.

SUMMARY OF THE INVENTION

These and other objects of this invention are achieved by providing an ultrasonic golf club cleaning apparatus comprising a first tank for receipt of the club grip portion, a second tank for receipt of the club head portion, an acoustic wave generator, a tank filling mechanism, a tank emptying mechanism, a tank cleaning component, and an operational control unit. The tank filling mechanism is coupled to the first tank for filling the tanks with a cleaning liquid in response to the operational control unit. The acoustic wave generator is arranged to selectively produce acoustic waves in the cleaning liquid to effect the cleaning of the golf club portion(s) located therein for a predetermined period of time as established by the operational control unit.

DESCRIPTION OF THE DRAWINGS

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENT

Figure 1:
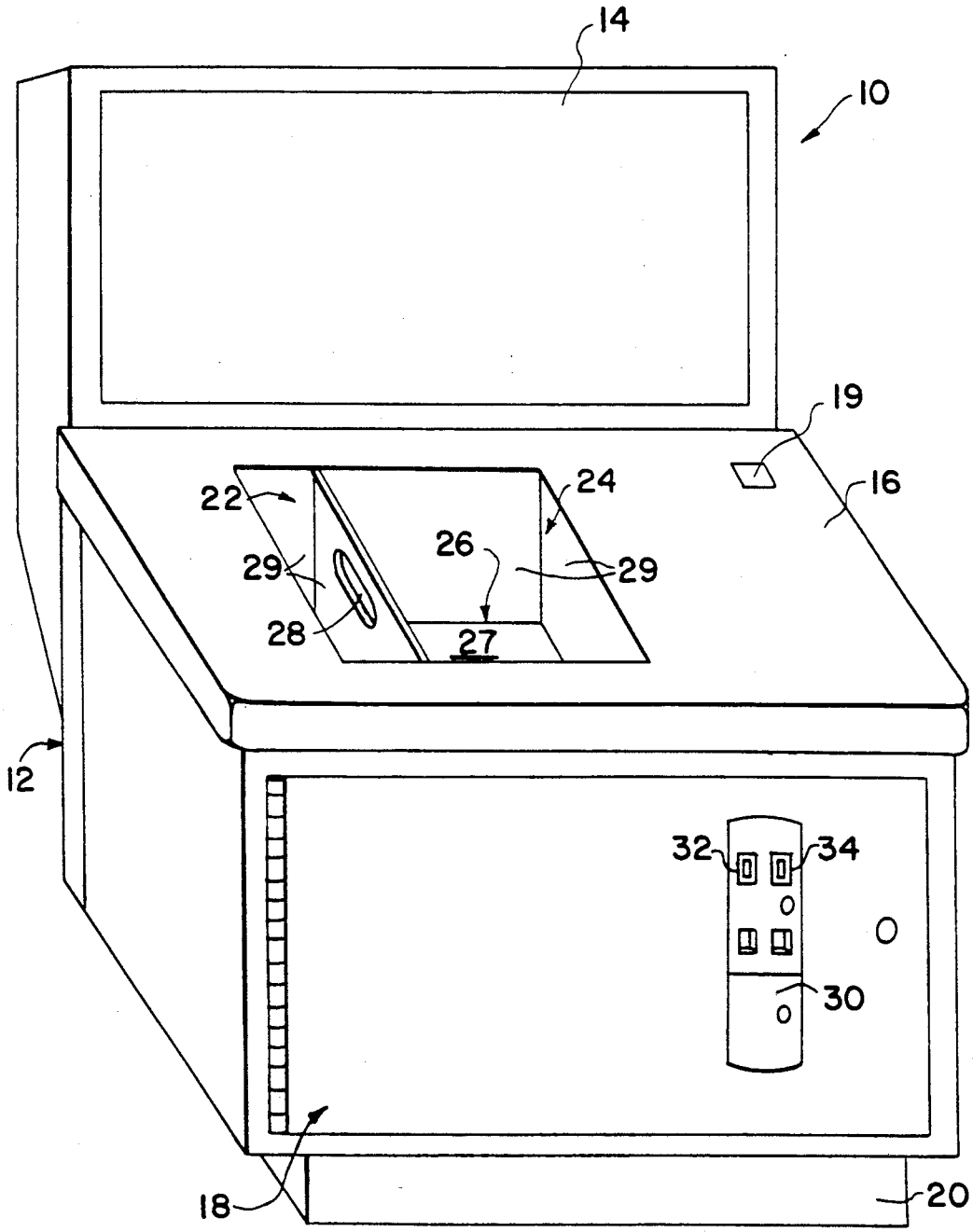
FIG. 1 is a front elevational view of the device of the present invention.

Referring now to various figures of the drawings where like reference numerals refer to like parts, there is shown at 10 in FIG. 1, a device constructed in accordance with this invention enclosed within a cabinet 12, having an instruction panel 14, a top surface 16 having a chemical tank level indicator light 19, a door 18, a base 20 and a conventional electrical connection (not shown). The device 10 preferably comprises two club cleaning tanks 22 and 24 positioned below the top surface 16. The first tank 22, holds a plurality of club grips to be cleaned and the second tank 24 holds a plurality of club heads which may be cleaned independently or concomitantly with the cleaning operation of the first tank 22.

Figure 2:
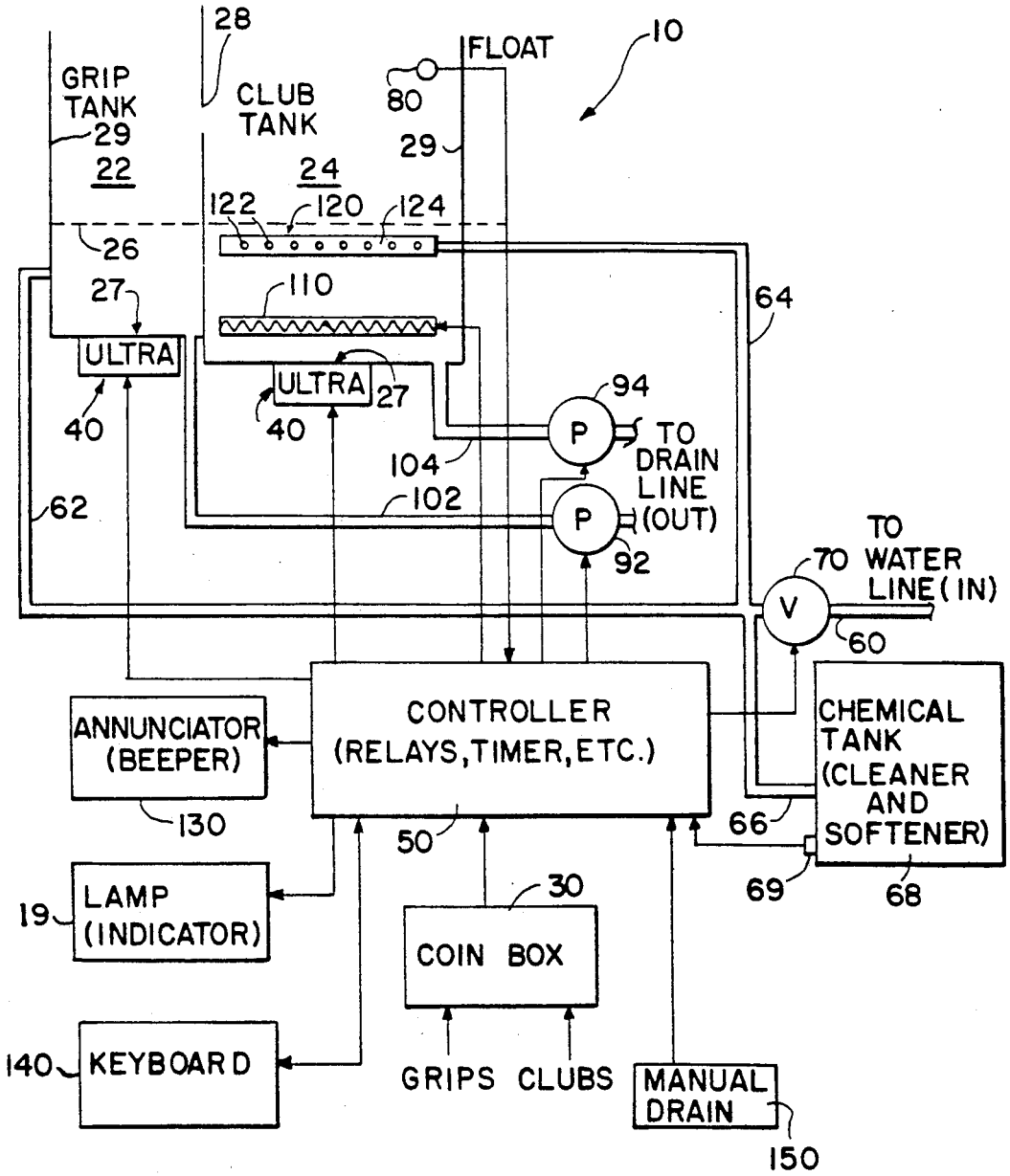
FIG. 2 is a schematic diagram of the components of the device of the present invention.

In the preferred embodiment, as schematically shown in FIG. 2, the bottom of the tanks 22 and 24 are preferably sloped so that the rear portion 26 of both tanks 22 and 24 is higher than the forward portion of the tanks. In addition, since the club grips are approximately 8 inches or more in length, the club grip tank 22 must be of sufficient depth (preferably 14.5 inch working depth holding approximately 1.69 gallons) to permit the cleaning solution to cover the portion desired to be cleaned. Since club heads are generally only a few inches high, the depth of club head cleaning tank 24 (preferably 5 inch working depth holding approximately 2.34 gallons) need not be as deep, if desired.

As can be seen in FIG. 1, the device 10 is preferably coin operated by insertion of a coin or token (not shown) into a conventional coin operated box 30 having slot 32 for activating the club grip cleaning apparatus to clean grips in tank 22. Insertion of a coin or token into slot 34 activates the club head cleaning apparatus to clean club heads in tank 24, all to be described in further detail below.

As shown in the diagram of FIG. 2, suffice it to say for now, that the functioning of the device 10 is automatically controlled by a controller 50 and additionally comprises the first and second cleaning tanks 22 and 24, respectively, and at least one conventional acoustic wave generator 40 adjacent each of tanks 22 and 24.

The device 10 further includes a conventional water inlet line 60 which branches into two lines, 62 and 64, connected to tanks 22 and 24, respectively, to automatically provide clean water to each tank when a conventional solenoid valve 70 is opened by the controller 50. As the water pressure of line 60 forces water therethrough, the premixed mixture of a typical detergent cleaning solution and softener (used to enhance the ultrasound capability)(not shown), stored in the chemical tank 68, is automatically pulled through line 66 in accordance with the suction created and mixes with the clean water in line 60 as the tanks 22 and 24 are filled to the desired level. The level of water in the tanks 22 and 24 is equalized by the opening 28 which permits the higher level of solution to flow through the opening into the tank having a lesser amount of solution.

In the event the liquid stored in the chemical tank 68 a predetermined low level such as by evaporation, the fluid level sensor 69, will send a signal to the controller 50, which will send a signal to the lamp 19, to indicate to the user that it is necessary to add cleaning solution to chemical tank 68.

When the water level, in the tank 24 reaches a conventional float 80, a signal is sent to the controller 50 to stop the water flow by closing solenoid valve 70. Additionally, the tanks 22 and 24 are heated by a conventional heater 110, such as an electrical impedance immersion heater, preferably located in tank 24, which maintains the cleaning solution and water at a predetermined temperature, preferably approximately 125° Fahrenheit. In the preferred embodiment, the electrical heater 110 is surrounded by a perforated stainless steel shell (not shown) which prevents a person from burning their hand should they accidentally place it into the tank in the region where the heater is attached.

After a predetermined number of cleanings, e.g., twenty, which may be adjusted by programming the controller 50 depending upon the circumstances of use, the controller 50 will automatically empty tanks 22, 24, by turning on conventional fluid pumps 92 and 94, to drain sediment and fluid into standard drain lines 102 and 104 respectively. Simultaneously, the controller 50 will turn off the heater 110 so that it will not heat empty tanks 22 and 24, which could cause the heater 110 to burn out or potentially start an electrical fire or short circuit. When the pumps 92 and 94 are turned off, the controller 50 will automatically turn the heater 110 on again to heat the fluid in the tanks 22 and 24 to the desired temperature. In an alternative embodiment, fluid pumps 92 and 94 may be replaced by a single pump.

Additionally, in order to automatically clean the tanks 22 and 24 when desired, the controller 50 opens solenoid valve 70 to permit water and cleaning solution to flow into tanks 22 and 24, while simultaneously draining fluid therefrom via pumps 92 and 94 and into drain lines 102 and 104. The device 10 also comprises a manual drain 150 to drain the tanks, in the event the pumps 92 and 94 malfunction. Since club heads have a tendency to become more soiled than club grips, the club head cleaning tank 24 additionally has a spraying device 120, connected to line 64. Preferably the spraying device 120 is located above and along the longitudinal rear edge of tank 24 for producing a jet spray of liquid therethrough to clean the tank via the pressure of the liquid passing through holes 122 of tube 124. The jet spray will thereby force the sediment (not shown) lying on the tank bottom (not shown) into the drain line 104 which is preferably located at the front and lowest portion of tank 24. If desired, one could also provide such a jet spraying device for grip tank 22.

After a predetermined time, the tanks 22 and 24 will be sufficiently cleaned and the controller 50 will automatically turn off pumps 92 and 94 so that the tanks 22 and 24 will be filled by the flow of water and cleaning solution and softener. When the fluid level reaches float 80, the controller will automatically turn off the liquid flow by closing solenoid valve 70.

As shown in FIG. 2, the device 10 additionally comprises at least one conventional acoustic wave generator 40 in each of tanks 22 and 24. The generators 40 are arranged to selectively produce acoustic waves in the cleaning liquid to effect the cleaning of the golf club portion(s) (not shown) located therein for a predetermined period of time as established by the controller 50. Since club grips may be cleaned in tank 22, independently or concomitantly with club heads in tank 24, in the preferred embodiment, the acoustic wave generators 40 in each respective tank are separately controlled by controller 50. Although the acoustic wave generators 40 may be positioned in the tanks in any fashion, it is preferred that they be secured to the lower portion of the tanks, e.g., side mounted and bottom mounted, so that the acoustic waves are directed towards and against the club portions to be cleaned.

In addition, in the preferred embodiment, the device 10 comprises a plurality of wave generators 40 in each tank, depending upon the tank volume, amount of liquid therein and the desired number of clubs to be cleaned. It is preferred that the grip tank 22 have approximately 3 or 4 acoustic wave generators 40 and the club head tank 24 have approximately 16 acoustic wave generators which are optimally positioned to clean the respective club portions. The tanks 22 and 24 may be comprised of any suitable resilient material such as plastic, stainless steel, etc., which provides a minimum of maintenance and yet does not substantially detract from the performance of the acoustic wave generators 40.

As shown in FIG. 1, and as previously described, each of the tanks 22 and 24 is comprised of generally downwardly extending wall portions 29 and a bottom 27. The rear portion of each tank 26 is preferably elevated above the front and lower portion (not shown) of the tanks. Additionally, the wall portions 29 and bottom 27 may be sloped and/or configured to permit the golf clubs to be optimally positioned during the cleaning cycle. The sizes of the tanks 22 and 24 may be of any suitable size depending upon the number of clubs to be cleaned. In the preferred embodiment, the grip tank 22 will hold up to 14 grips and the club head tank 24 will hold up to 14 club heads simultaneously, although the tanks are sufficiently sized to hold more than this number.

In addition, the controller 50 acts as an anti-theft indicator by monitoring and counting each time the solenoid valve 70 opens to emit water and cleaning fluid, each time the pumps 92 and 94 are activated, each time the float 80 is utilized, the number of times the grip cleaning tank 22 is activated via the coin box 30, the number of times the head cleaning tank is activated, etc.

The administrator of the device 10 at the golf course, for example can then obtain these figures via a keyboard 140, which permits him/her to compare these figures with the number of tokens (or coins) in the coin box 30, to determine if anyone has tampered with the device or has successfully utilized the device without inserting a token or coin into the device.

To clean the club heads and/or grips, one or more of the club heads and/or grips may be inserted into the appropriate tanks which are constantly maintained preheated and pre-filled with cleaning solution and softener. A token or coin is inserted into the coin box 30 to activate the cleaning cycle in each of the tanks 22 and 24. Since the cleaning cycles in each tank are preferably independently operated, two coins or tokens may be inserted simultaneously or sequentially after the completion of one cycle.

In the grip cleaning tank 22, preferably the cleaning cycle will run approximately 60 seconds, after which the acoustic wave generators 40 therein will automatically shut off. The person using the device 10 will be able to perceive the machine turning off visually, when the light (not show) of the coin box 30 for the grip tank 22 shuts off, and/or when the person hears the generators 40 stop functioning. The club grips are then cleaned and ready to be removed from the tank 22.

It should be readily apparent to those skilled in the art that the duration of the cleaning cycle may be adjusted by pre-programming the controller 50 accordingly. In the preferred embodiment, the controller 50 is not accessible to the public using the device 10, so as to prevent improper use thereof.

Similarly, in the club head cleaning tank 24, the cleaning cycle will run approximately 2 minutes, after which the acoustic wave generators 40 therein will automatically shut off. After 45 seconds into the cleaning cycle however, the controller 50 will signal a beeper or annunciator 130 to audibly signal the person to remove from the tank 24, any golf clubs having wooden heads, so as to not damage them by the extended cleaning cycle used for metal club heads. The person using the device 10 may be able to perceive the machine turning off visually, when the light (not shown) of the coin box 30 for the club head cleaning tank 24 shuts off (if this option is provided), and/or when the person hears the generators 40 stop functioning. The club heads are cleaned and ready to be removed from the tank 24. It should be readily apparent to those skilled in the art that the duration of the cleaning cycle in tank 24 may also be adjusted by pre-programming the controller 50 accordingly.

In order to optimize the cleaning capability of the acoustic wave generators 40, it is preferred that the solution in the tanks 22 and 24 be "degassed" prior to any cleaning cycle, which may be accomplished by the use of the softener chemical and/or by activating the generators 40 via controller 50 for a short time period prior to any cleaning cycle. Preferably the detergent cleaning solution and softener chemical used with the device 10 is the Morantz Ultrasonic Cleaner and Morantz Water Activator, sold by S. Morantz, Inc., 9984 Gantry Road, Philadelphia, Pa. 19115, although any comparable solutions may be utilized depending upon the circumstances of use.

Without further elaboration the foregoing will so fully illustrate my invention that others may, by applying current or future knowledge, adopt the same for use under various conditions of service.

I claim:

1. Apparatus for brushless cleaning a portion of a golf club, having a grip and a head portion, said apparatus comprising:

a. tank means for receipt of a portion of said golf club therein, wherein the tank means comprises a first tank for receipt of the grip and a second tank for receipt of the head portion, said apparatus further comprising;

b. acoustic wave generation means;

c. tank filling means to add the necessary water and chemicals forming a cleaning liquid in said tanks;

d. cleaning liquid heating means for heating the cleaning liquid in said tank means;

e. tank emptying means;

f. tank cleaning means comprising a spraying device;

g. operational control means; said tank filling means and said cleaning liquid heating means operating in response to said operational control means and said tank cleaning means being also controlled by said operational control means to be operative after said cleaning liquid has been removed from said tanks through said tank emptying means, said tank emptying means being controlled by said operational control means and becoming further operative after said tank cleaning means has acted to clean the sides of said tank means;

said tank filling means being coupled to said tank means for filling said tanks with a cleaning liquid in response to said operational control means, said acoustic wave generation means being arranged for selectively producing acoustic waves in the cleaning liquid within said tanks to effect the cleaning of the golf club portions located therein for a predetermined period of time as established by said operational control means.

2. The apparatus of claim 1 wherein said spraying device is provided with a cleaning liquid to spray said tank means for a predetermined period of time in response to said operational control means.

3. The apparatus of claim 2 wherein said tank emptying means is responsive to said operational control means for selectively emptying at least one of said tanks.

4. The apparatus of claim 3 wherein said spraying means is operated by said operational control means after said tank means is emptied by said tank emptying means.

5. The apparatus of claim 4 wherein said tank emptying means comprises at least one pump coupled to said operational control means.

6. The apparatus of claim 1 wherein said tank filling means comprises level sensing means for sensing when the liquid within one of said tanks has reached a predetermined level, said level sensing means being coupled to said operational control means.

7. The apparatus of claim 6 wherein said level sensing means comprises a float.

8. The apparatus of claim 1 wherein said tank filling means comprises at least one storage vessel for holding a first cleaning liquid therein, said tank filling means providing said first cleaning liquid to said first and second tank means.

9. The apparatus of claim 8 wherein said tank filling means is coupled to a water line for carrying water and said first cleaning liquid to said first and second tanks.

10. The apparatus of claim 9 wherein said tank filling means additionally comprises controllable valve means coupled to said operational control means for enabling said tank filling means to carry said water and said first cleaning liquid to said first and second tanks.

11. The apparatus of claim 1 additionally comprising signaling means to provide a perceptible signal to the user of said device to indicate the status of operation of said apparatus.

12. The apparatus of claim 11 wherein said signaling means comprises an audible annunciator.

13. The apparatus of claim 12 wherein said audible annunciator provides an audible signal a predetermined time after said acoustic wave generator means commences operation.

14. The apparatus of claim 1 additionally comprising means to receive a coin or token for providing a signal to said operational control means.

15. The apparatus of claim 14 additionally comprising manually operated switch means for providing at least one signal to said operational control means to cause said acoustic wave generation means to operate.

16. The apparatus of claim 15 wherein the length of time that said acoustic wave generating means is operated is a function of said at least one signal.

17. The apparatus of claim 14 wherein the apparatus additionally comprises counting means for permitting the administrator of the apparatus whether the apparatus has been utilized without insertion of a coin or token into the means for providing a signal to said operational control means.

18. The apparatus of claim 17 wherein the counting means comprises a keyboard.

19. The apparatus of claim 1 wherein said tank emptying means is responsive to said operational control means for emptying said tanks upon the occurrence of a predetermined event.

20. The apparatus of claim 19 wherein said predetermined event comprises the operation of said apparatus a predetermined number of times.

* * * * *